US006098366A

United States Patent [19]

Guichard

[11] Patent Number: 6,098,366

[45] Date of Patent: Aug. 8, 2000

[54] CONNECTOR FOR SOLID OR HOLLOW PROFILE SECTIONS

[75] Inventor: Jacques Guichard, Nantes, France

[73] Assignee: Guichard S.A., Nantes, France

[21] Appl. No.: 08/981,868

[22] PCT Filed: Jun. 28, 1996

[86] PCT No.: PCT/FR96/01009

§ 371 Date: Jan. 26, 1998

§ 102(e) Date: Jan. 26, 1998

[87] PCT Pub. No.: WO97/02389

PCT Pub. Date: Jan. 23, 1997

[30] Foreign Application Priority Data

Jul. 4, 1995 [FR] France ..... 95 08217
Dec. 20, 1995 [FR] France ..... 95 15615

[51] Int. Cl.[7] ..... E04B 1/19; E04B 1/38; E06B 3/96

[52] U.S. Cl. ..... 52/655.1; 52/653.1; 52/656.9; 52/747.1; 52/749.1; 403/230

[58] Field of Search ..... 52/712, 656.9, 52/653.2, 655.1, 747.1, 749.1; 403/230, 256, 258, 260

[56] References Cited

U.S. PATENT DOCUMENTS 4,518,278 5/1985 Koch ..... 403/230
5,544,866 8/1996 Dye ..... 403/230 X

*Primary Examiner*—Christopher T. Kent

[57] ABSTRACT

A connector for profile sections having axes that intersect at a certain angle (α, β) includes a connecting member folded or cut so that it defines a bearing surface provided with a through-bore and arranged to be attached to any one of the surfaces of a first profile section, the connecting member being pivotable about a first axis parallel or orthogonal to the longitudinal axis of the through-bore, and at least one portion of the member further being pivotable about a second axis orthogonal to the first axis (D1); the part of the connector located beyond a plane parallel to the first axis and passing through the second pivot axis forms an initial attachment portion to which a second profile section is attached either directly or by an insert.

5 Claims, 6 Drawing Sheets

CONNECTOR FOR SOLID OR HOLLOW PROFILE SECTIONS

The present invention relates to a connector for hollow or solid profiles whose axes intersect at any angle, a process for connecting hollow or solid profiles by means of said connector and a tool assembly or tool kit for practicing said process.

The provision of light structures, such as verandas, glass walls or the like, requires the use of strong structural elements for creating the framework. This framework is thus generally made of wooden elements, plastic elements, metallic elements, composite elements or mixed elements, these elements being solid or hollow. The assembly of said elements with each other can be carried out as described in French patent FR-A-2.667.011 by means of a connection member inserted within the respective cavity provided in each element to be assembled. However, with such connecting members, a connection of the beams along their axes of intersection of various angles is not attainable. The connecting device described in European patent EP-A-0.604.244 has the same drawbacks. The connecting member between said construction elements is constituted by first and second connector elements which are either secured to each other or articulated on each other. In the two embodiments, the angles that can be obtained are generally limited either to a single value, or to a range of values disposed all in the same plane. The connecting device described in French patent FR-A-2.624.153 has the same drawbacks. It is also constituted by two articulatedly interconnected elements. Such a device is complicated and hence cumbersome.

The object of the present invention is thus to overcome the above drawbacks by providing a connector permitting the assembly of solid or hollow profiles with axes of intersection of any angular values.

Another object of the present invention is to provide a connector that is easy to produce and in which any orientation can be obtained by means of a single member that is not articulated to a second element.

Another object of the present invention is to provide a process for connecting profiles by means of said connector which will be simple and rapid to use by any operator including non-professional operators.

To this end, the invention has for its object a process for the assembly of hollow or solid profiles with axes of intersection at any angular values, by means of a connector constituted by a connector body in the form of a blade or of a block providing, after bending the blade or cutting out the block, a bearing face provided with a through hole and arranged to be secured on any of the surfaces of a first profile, in which process the assembly body is pivotally mounted about a first axis, for a blade parallel, and for a block orthogonal, to the longitudinal axis of said through hole so as to predetermine an orientation of the connector about said axis corresponding to a first selected angular value of the connector, at least one part of said body being moreover mounted pivotably about a second axis orthogonal to said first axis so as to predetermine an orientation of the connector about the axis corresponding to a second predetermined angular value of the connector, the portion of the connector located beyond the plane parallel to said first axis and passing through the second pivotal axis constituting an initial securement on which is secured directly or by means of an added member, a second profile whose distal portion has first been cut off on a plane corresponding to the selected angular connection.

According to a first embodiment of the process, the connector is oriented according to first and second selected connector angular values, the bearing face of said connector is delimited by sawing the connector on a cutting plane that coincides with the plane parallel to said first axis of orientation of the connector and passing through the second axis of orientation of said connector, the connector is fixed on the first profile by means of a first securement member and the second profile is fixed on the connector by means of a second securement member.

According to a second embodiment of the process, there is produced, by bending the end of the connector provided with a through hole for its securement to the first profile, a bender having at least two upper and lower gripping jaws forming a vise, the lower jaw comprising, projecting from its gripping surface, a lug arranged to penetrate the through hole of the connector, in that, in a first instance, the connector is oriented by rotation about said lug of the bender and in that the connector is immobilized in a predetermined angular position adjustable about any angle, in that, in a second instance, the connector is bent by means of a pivoting plate, disposed adjacent the jaws, in a plane parallel to or coinciding with the gripping plane of the jaws, this blade forcing, in the course of its pivoting about an axis parallel to the longitudinal axis of said jaws, the connector to bend at a predetermined adjustable angle about the longitudinal edge of the upper jaw, this ridge of the upper jaw, this ridge forming the bending axis.

Moreover, the initial of securement of the connector is adapted to constitute an anchoring hub adapted to be introduced into an axial cavity of the second profile to be connected and in that the immobilization between the first and second profiles is ensured by means of a securement member passing through at least one of the surfaces of the second profile to be connected and the anchoring hub or a piece connected to or disposed within said anchoring hub.

The invention also has for its object a connector for connecting hollow or solid profiles along axes of intersection of any angular values, of the type comprising a bearing surface provided with a through hole and arranged to be secured to any one of the surfaces of a first profile and an initial securement for the securement of a second profile whose distal portion has first been cut along a cutting plane corresponding to the manner of angular connection selected, characterized in that the bearing surface and the initial securement of said connector are obtained by the practice of the mentioned process.

Independently of the embodiment of the process that is followed, prior to the securement of the connector on the profiles, there is marked on the first and second profiles, by means of templates, the securement and gripping holes to be provided, and these holes are then formed by means of a machine tool whose piercing tool passes through a piercing barrel disposed on the template.

The invention also relates to a tool assembly or tool kit for practicing the connecting process of two profiles, characterized in that it comprises at least one bender or cutting tool and two templates, one serving for the production of a hole for securement of the first profile, a other serving for the production of a gripping hole for a second profile, these holes permitting the securement of the connector to said profiles.

The invention will be better understood from a reading of the following description of embodiments, with reference to the accompanying drawings, in which.

Figure 4:
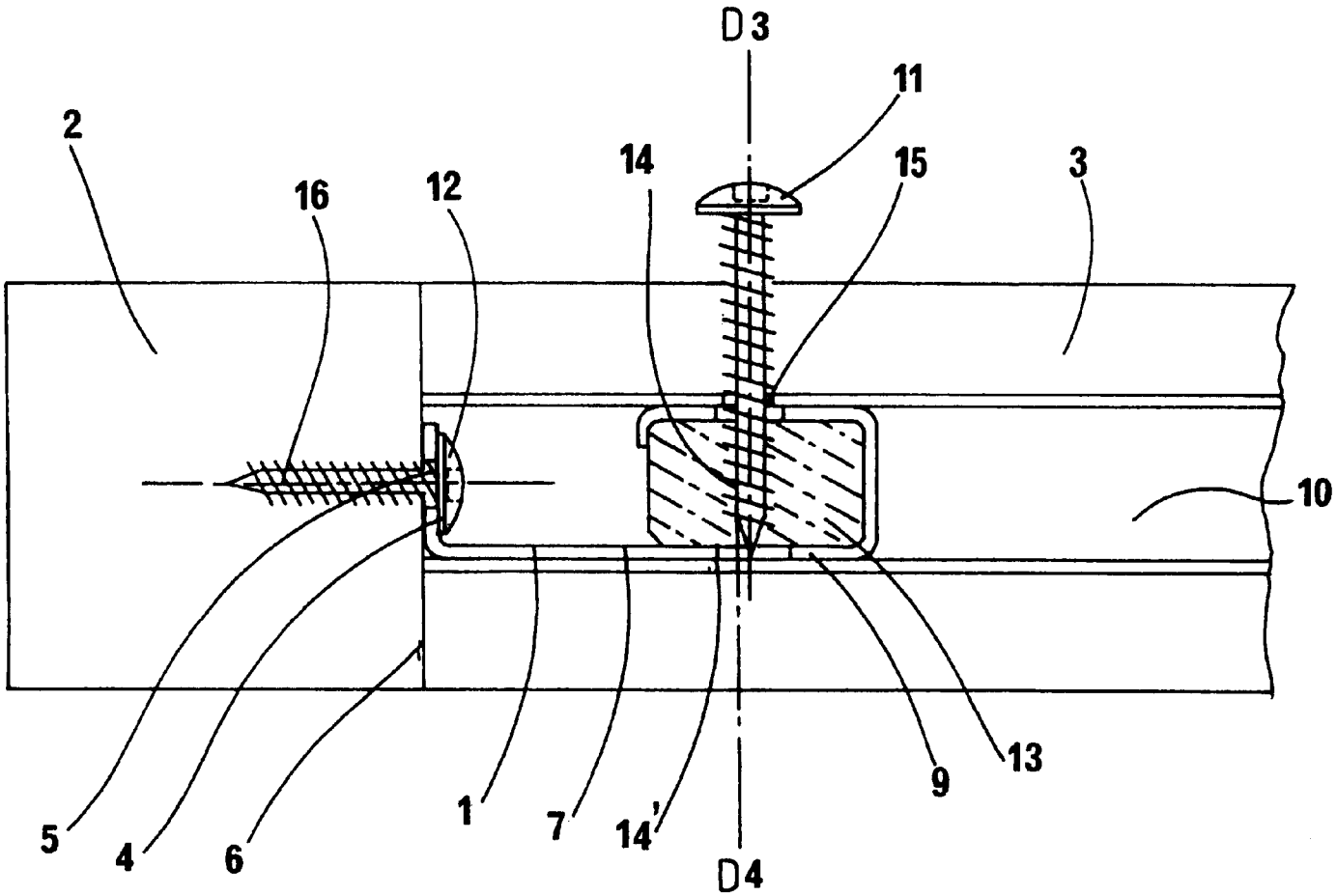
FIG. 4 is a cross-sectional view of a connector formed by a blade in a square mounting of the two profiles also shown in cross section.
Figure 5:
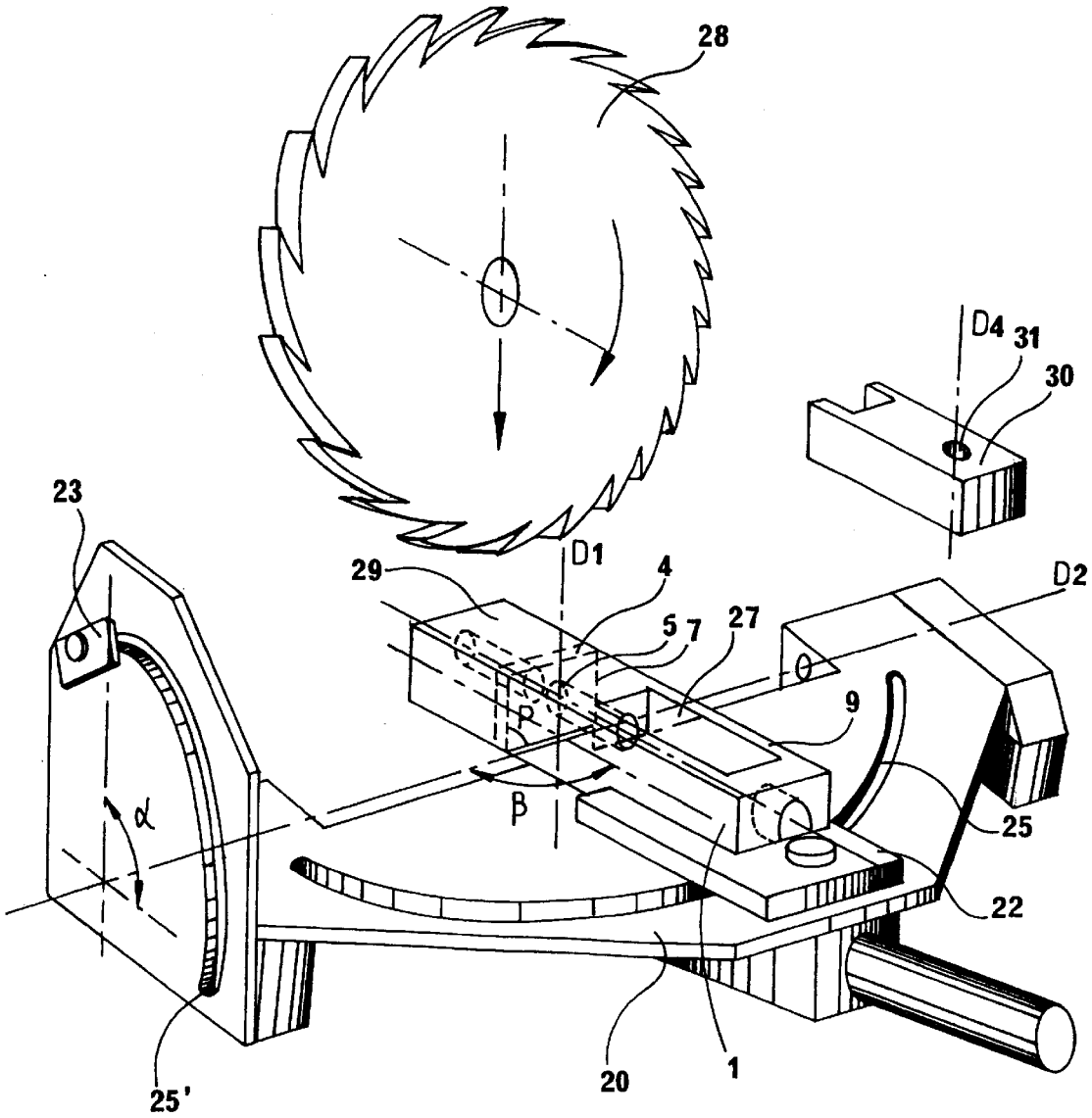
FIG. 5 is a simplified schematic perspective view of a cutting tool coacting with an orientable support, the assembly being adapted to be used for cutting out a connector of the invention formed by a block.
Figure 6:
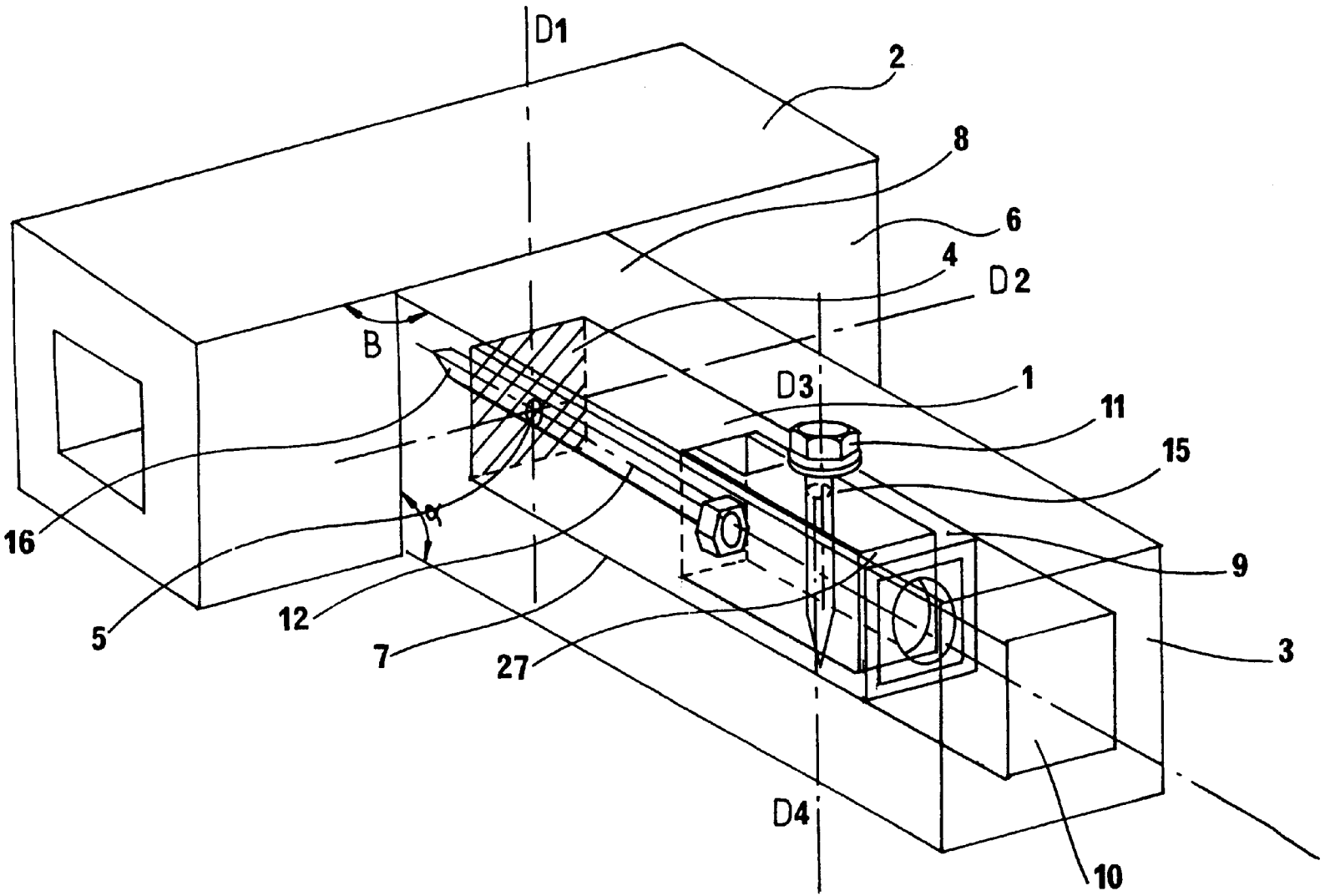
FIG. 6 is a perspective view of a connector formed by a block showing the condition fixed to two profiles, the profiles being shown transparent.

The connector 1, according to the invention, is comprised by a connector body in the form of a blade, generally of metal (FIGS. 1 to 4), or of a plastic or metal block (FIGS. 5 and 6). This connector is used for assembling a first profile 2 and a second profile 3.

These profiles, solid or hollow, can be of any material. A preferred solution according to the invention consists however in using profile sections constituted by solid or hollow wood beams.

In the case of hollow beams, a conventional solution consists in cementing on the surfaces of a metallic profile constituting a hollow tubular core, wood elements constituting an envelope of said core. However, the assembly and connection of such different materials as wood and metal has drawbacks. Thus, the connection, generally carried out by cementing between the wood and the metal, is very delicate and unreliable. It presupposes moreover a necessary preparation of the metallic surfaces. Finally, the presence of these metallic surfaces generates risks of corrosion or oxidation as well as condensation that is deleterious to wood. Similarly, there are known important differential dimensional variations due to expansion.

Figure 2:
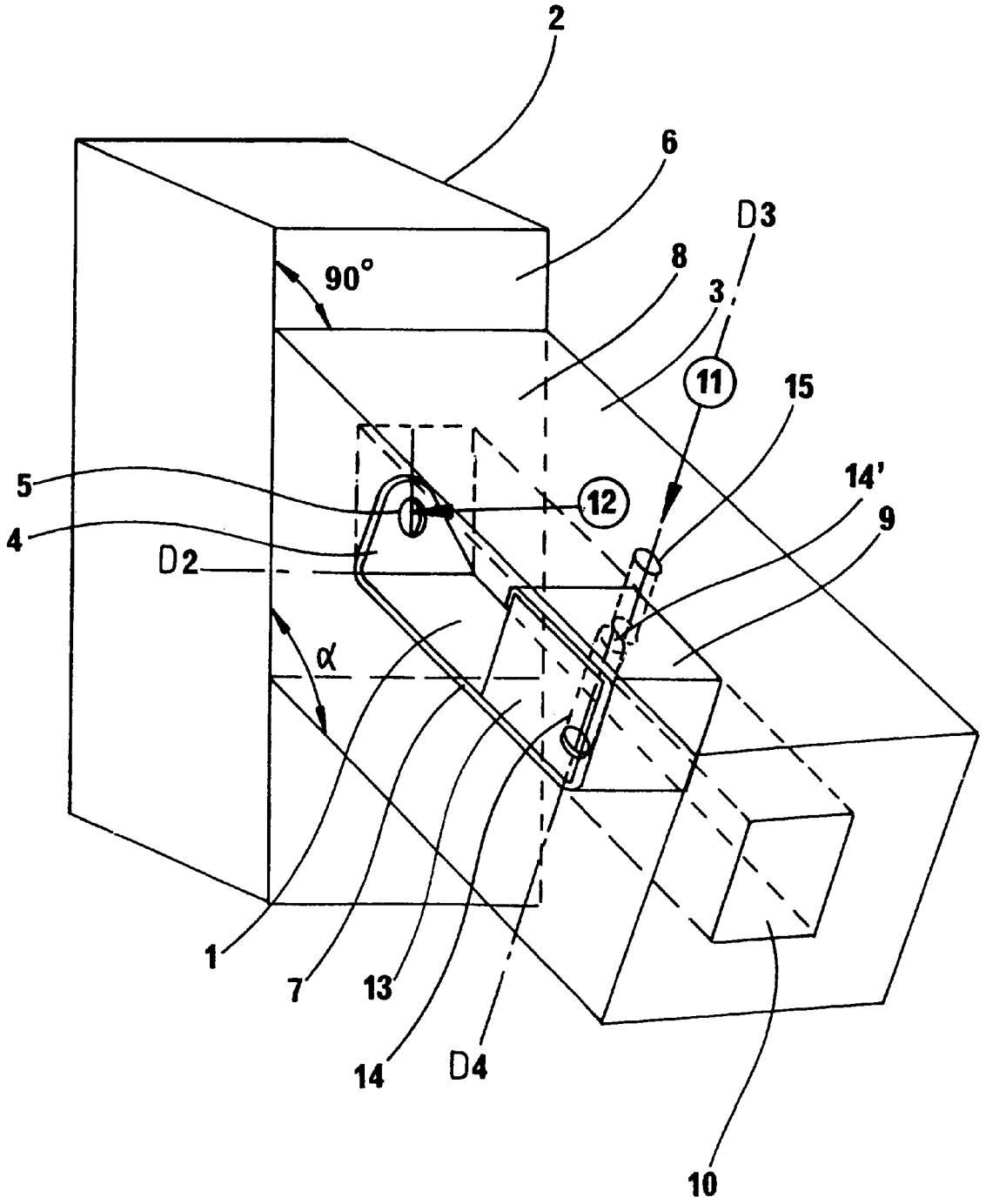
FIG. 2 is a perspective view of the connector formed by a blade shown in the condition secured to two profiles, the profiles being shown in phantom lines.
Figure 3:
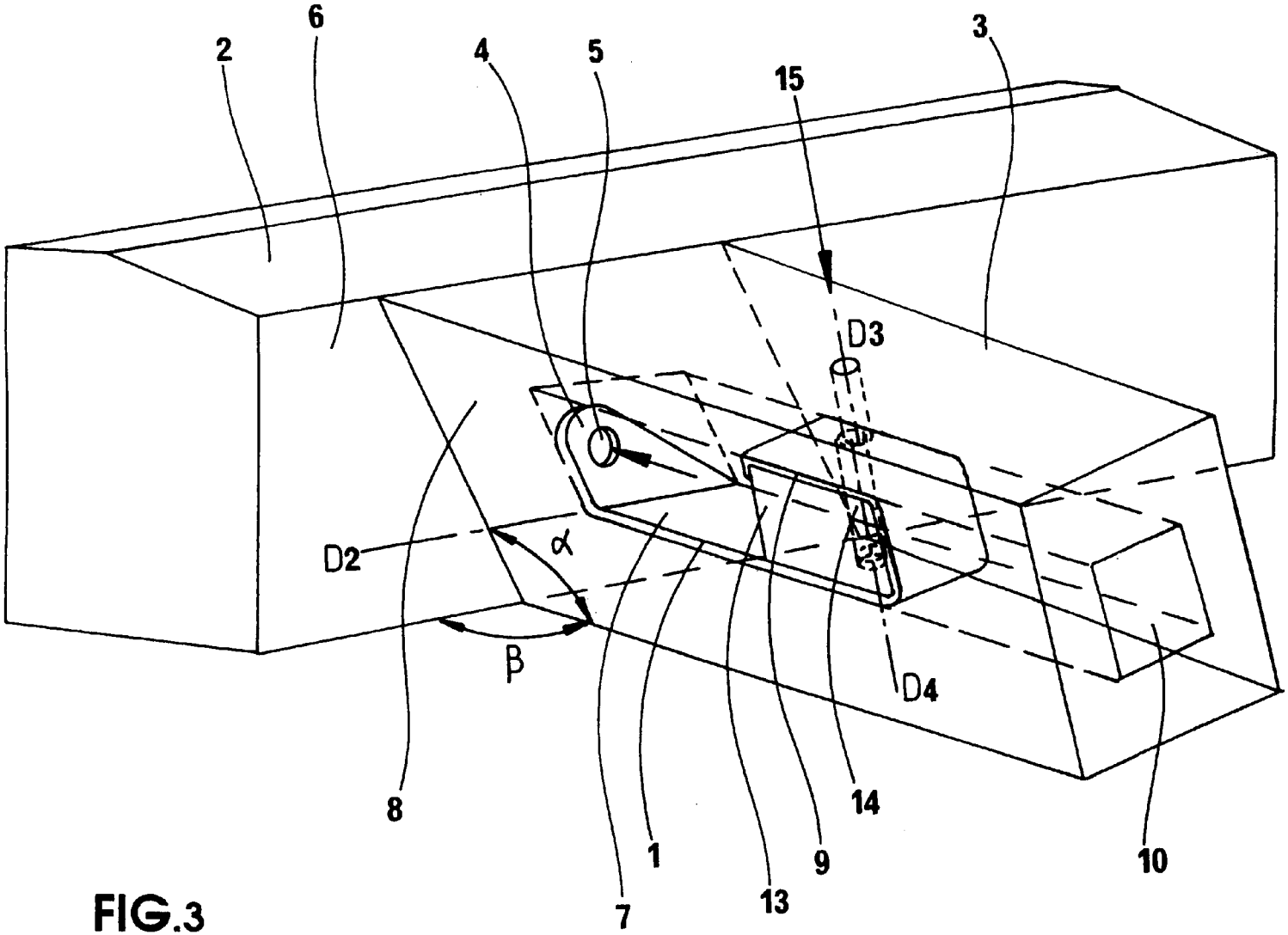
FIG. 3 shows a modification of FIG. 2 in which the positioning of the profiles and the angular values of the axis of intersection of the profiles with each other have been modified.

Another more practical solution therefore consists in using a beam of the type comprising a polyhedral stiffening, this core being covered, over substantially all its length, with wooden elements surrounding said core and constituting an envelope of said core, this beam being characterized in that the core is constituted essentially of reinforcing materials and of an impregnation binder shaped by pultrusion, whilst the wooden elements of the envelope are formed by one or several thicknesses of pieces of wood assembled in edgewise abutting relationship to obtain a length for an element of wood at least equal to the length of the core. By way of example, the impregnation binder taking part in the compensation of the core is preferably a polyester isophthalic resin representing substantially 45% of the composition of the core. Reinforcing materials can be present in the composition of the core in the form of filaments, cloths and/or mats essentially of glass fiber base, these reinforcing materials having substantially 55% of the composition of the core. Such a beam is shown by the profile 3 in FIG. 2. The stiffening core thus provides an axial cavity 10 within said profile 3 as shown in FIG. 2. The interest of such profiles is to permit the production of particularly solid frameworks adapted to support heavy loads. Moreover, this recess 10 permits masking the connector, thereby rendering the connection aesthetically pleasing.

In a first embodiment of the invention according to FIGS. 1 to 4, the connector 1 is constituted by a connector body in the form of a blade.

This blade is secured at one of its ends 4 on any one of the surfaces, for example the surface 6, of a first profile 2. This blade can be oriented about its point of securement at any angle β then bent as needed relative to the initial plane of securement corresponding to the surface 6 of said first profile so as to constitute an initial securement 7 on which is secured a second profile 3 whose distal portion 8 has been first shaped to a cutoff plane corresponding to the selected manner of angular securement. This shaping can be carried out by means of a sectioner with two axes, in a manner known per se.

Figure 1:
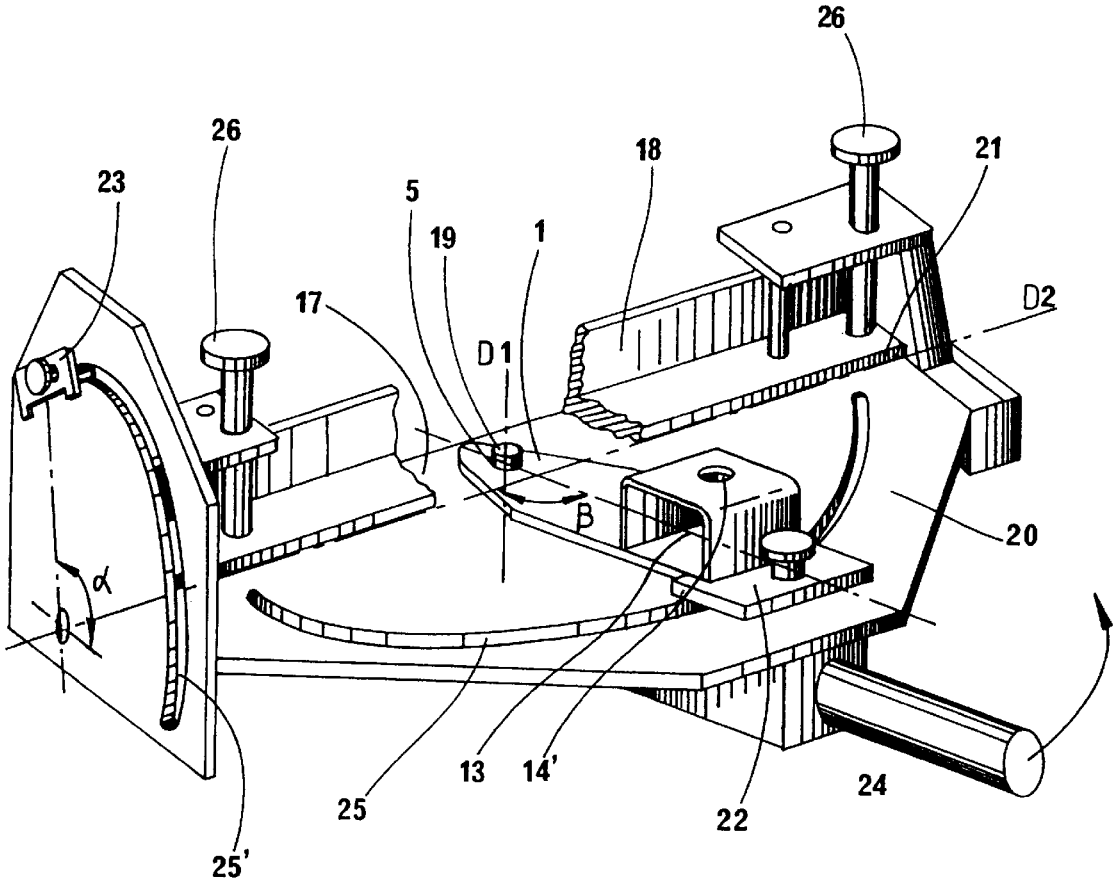
FIG. 1 is a perspective view of a bender adapted to be used for bending a connector of the invention, formed by a blade.

The operations of orienting and bending the end 4 of the connecting blade comprising the connector 1 can be carried out for example by means of a bender of the type shown in FIG. 1. This bender comprises a frame constituted by two flanks disposed parallel to each other and interconnected by means of a gripping jaw 17 called a lower jaw. This lower jaw 17 coacts with an upper jaw 18 arranged to be spaced from or brought toward lower jaw 17. The two gripping jaws respectively the lower one 17 and the upper one 18, form a vise in which the connector blade can be inserted. These gripping jaws 17 and 18 can be maintained in closed position by means of locking screw 26 which tends, by bearing against the upper jaw 18, to press it toward the lower jaw 17 as shown in FIG. 1. The gripping portions of said jaws have the shape of blades. The lower jaw 17 also comprises, projecting from its gripping or bearing surface, a lug or swivel pin 19. In addition to these upper and lower jaws 17 and 18, the bender is provided with a pivoting plate 20 disposed adjacent the jaws 17, 18 in a plane parallel to or coinciding with the gripping plate of said jaws. Generally, this plate 20 is disposed substantially in prolongation of the bearing surface provided by the lower jaw 17. This plate 20 is articulated on the frame of the bender to be pivoted about an axis parallel to the longitudinal axes of the jaws 17 and 18. This plate 20 moreover comprises an adjustable abutment 22. This abutment 22 is adapted to be moved within a circular guide groove 25 provided in this plate 20. This adjustable abutment 22 coacts with the lug 19 disposed projecting from the gripping surface of the lower jaw 17 to ensure immobilization of the connector 1 mounted rotatably about the lug 19 in a predetermined angular position that is adjustable relative to the longitudinal axis of said jaws. In a similar manner, at least one of the flanks constituting the frame of the bender comprises an adjustable abutment 23 adapted to be displaced and immobilized within a circular guide groove 25' provided in said flank. This abutment 23 constitutes the stopping point of the pivotal movement of the plate 20. This plate is moved by means of a handle 24. The connector is accordingly bent by pivoting the plate within a predetermined angular range which is adjustable so as to form a bend about the longitudinal edge of the upper jaw, this edge constituting the bending axis D2.

The connector adapted to be bent by means of the bender described above comprises at its end 4, at a point corresponding to its point of securement on the first profile 3, a through hole 5. To be able to bend the end 4 of the connector 1 by means of the bender described above, the end 4 of the connector is disposed between the gripping jaws 17 and 18 of the bender such that the lug 19 of the lower jaw 17 enters the through hole 5 of the connector, as shown in FIG. 1. This connector is accordingly oriented by rotation about the lug 19 such that the longitudinal axis of the connector forms with the longitudinal edge 21 of the upper jaw, which constitutes the axis of the bend line D2, an adjustable predetermined angle β selected by the user. This angle β corresponds to the angle of orientation of the connector, which is to say the actual angle of the two profiles to be assembled in the plane formed by them. This angle β is preferably at least equal to 17.50°. Once the connector 1 is correctly oriented, it is immobilized in said predetermined position on the plate 20 by means of the adjustable abutment 22 adapted to move in the groove 25. In a second instance, the connector 1 is bent by means of the pivoting plate 20 disposed adjacent the jaws 17, 18 in a plane parallel to or coinciding with the gripping plane of said jaws. This plate 20, in the course of its pivoting about an axis parallel to the longitudinal axis of said jaws, forces the connector 1 to bend at an adjustable predetermined angle a about the longitudinal edge 21 of the upper jaw 18, this edge forming the axis D2 of bending. This angle a shown in FIG. 1 is adjusted by the operator by means of the adjustable abutment 23 by moving this latter in the circular groove 25'. Thus bent, the connector can be secured to the first profile 2.

Because the bearing surface 4 of the connector 1 is provided, at its securement point on the first profile 2, with a through hole 5, the securement to the first profile takes place by means of a securement member 12 which passes through said through hole 5 and enters a hole 16, a so-called securement hole, provided in the securement surface 6 of said first profile 2, as shown in FIG. 4. This securement member 12 is for example constituted by a screw. So that the operator can, after the operation of bending, transfer the angles $\alpha$, $\beta$ to the profiles, the connector can be secured to the first profile 2 such that the bending axis D2 of the connector will be parallel or perpendicular to the longitudinal axis of the profile.

The initial securement 7 thus constituted, on which can be secured the second profile 3, can have a large number of shapes. It could thus have the form of a flat in which would be provided a through hole for the securement to the second profile. This embodiment could particularly be used in the environment of an assembly in which the second profile 3 will be a solid profile, the connector being secured abutting against one of the external surfaces of this profile. However, a preferred embodiment of the invention consists in shaping the connector so a s to permit the securement of a second hollow profile 3 on a first profile of any type. In this case, the second profile 3 comprises an axial recess 10 as already described above. The initial securement 7 is then shaped to constitute an anchoring hub 9 adapted to be introduced into the axial recess 10 of the second profile 3 to be connected. Immobilization of the first and second profiles relative to each other is effected by means of a securement member 11 passing at least through one of the surfaces of the second profile 3 to be connected and the anchoring hub 9.

The anchoring hub 9 can in turn have a large number of shapes. However, a simple solution is obtained when the anchoring hub 9 has the shape of a cage obtained by bending successively from the initial securement 7 as shown in FIGS. 1 to 4. The cage thus produced encloses a block 13 ordinarily of plastic material. This block 13 has a through hole 14 disposed facing at least one hole 14' of the cage for the passage of the securement member 11 of the second profile 3. Moreover, it should be noted that the axis D3 of hole 15 provided in the second profile 3 and the axis D4 of the hole of the anchoring hub 9 are offset so as to obtain, under the influence of penetration of the securement member 11, a gripping effect tending to apply the distal surface 8 of the profile 3 to be connected, against the securement plane of the first profile 2. In short, the assembly process described above consists, in its simplest form, in bending the connector previously oriented by means of a bender, securing the connector to the first profile 2 by means of a first securement member 12, securing the second profile 3 to the connector 1 by means of a second securement member 11, the distal surface 8 of this second profile having been first shaped.

In a particular embodiment of the process of the invention, the operator can, prior to the securement of the connector to the profiles, mark on the first and second profiles, by means of templates, the position of the securement hole 16 and the gripping hole 15 to be provided and to provide said holes by means of a machine tool whose piercing tool passes through a piercing sleeve carried by the template. In this case, the operator should have a tool assembly or tool kit for practicing the process, this assembly comprising at least one bender and if desired two templates, one serving for marking the securement point of the connector on the first profile, the other serving for marking the point of securement of the connector on the second profile.

In an industrial embodiment of this process in which the profiles would be delivered to the operator pre-pierced, the templates could be omitted.

In a semi-industrial version, the anchoring hubs of the connectors are preformed in the factory, the holes of the profiles and the bending of the end 4 of the connector 1 taking place at the work place.

In a second embodiment of the invention according to FIGS. 5 and 6, the connector 1, which has the form of a block, comprises a large number of characteristics common to the first embodiment described above. This is why, in FIGS. 5 and 6, parts having identical functions to those of the parts described in FIGS. 1 to 4 have been designated with the same reference numbers. In the example of FIG. 5, the connector 1 is present initially in the form of a metal or plastic block comprising a first through hole 5 provided axially in said block in a second through recess delimiting a cavity 27 whose role will be described hereinafter. This block forming the body of the connector 1 is mounted pivotably about a first virtual axis D1 orthogonal to the longitudinal axis of the through hole 5 so as to fix an orientation of the connector about said axis D1 corresponding to a first angular value $\beta$ selected for the connector. This pivotal mounting of the connector is obtained by displacement of an abutment 22 within a circular guide groove 25 provided in a pivoting plate 20. This circular guide groove 25 is arranged about a center through which passes the axis D1. The abutment 22, movably secured to the connector 1, permits immobilizing the connector 1 in an adjustable predetermined angular position.

This plate 20 is provided with flanks between which it is pivotably mounted about an axis D2. In a manner analogous to that which was described for the bender of FIG. 1, this flank comprises a circular guide groove 25' within which an adjustable abutment 23 is adapted to be displaced and immobilized. This abutment 23 constitutes the stopping point for the pivotal movement of the plate 20. During displacement by pivoting the plate 20 through an angle $\alpha$, the body of the connector 1 orients according to a second selected angular value of the connector. In this position, a cutting tool 28, such as a circular saw, whose cutting edge is positioned in the plane P formed by the plane parallel to and/or coincident with D1 and passing through D2 is actuated to eliminate the portion of the connector represented at 29 in FIG. 5, located on one side of said plane P. The portion of the connector 1 located on the other side of said plane constitutes, in a manner analogous to that which was described in connection with the first embodiment, an initial securement 7 on which is directly secured or by means of an added member, a second profile 3 analogous to that described in the first embodiment. The portion of the connector located in the plane P constitutes the bearing surface 4 of the connector provided with a through hole 5 and arranged to be secured on any one of the surfaces 6 of the first profile 2. In short, the bearing surface 4 of said connector 1 oriented according to the first and second angular values selected for the connector, is delimited by sawing the connector on a cutting plane coinciding with the plane parallel to said first axis of orientation D1 of the connector and passing through the second orientation axis D2 of said connector. The securement of the connector on the first profile 2 takes place by means of a securement member 12 which passes through said through hole 5 provided in the bearing surface of said connector at the point of securement of the connector on said first profile 2, this securement member 12 passing through the hole 16 or so-called securement hole provided in the securement surface 6 of said first profile 2. This securement is analogous to that described in connection with the first embodiment.

Similarly, in a manner identical to the first embodiment, the initial securement 7 is shaped to constitute an anchoring hub 9 adapted to be introduced into the axial hole 10 of the second profile 3 to be connected, the immobilization between the first and second profiles 2, 3 taking place by means of a securement member 11 passing at least through one of the surfaces of the second profile 3 to be connected and the anchoring hub 9 or a member secured on or in said anchoring hub.

In the example shown in FIGS. 5 and 6, the anchoring hub 9 has the shape of a cage delimited by walls of a through hole 27 provided in the body of the connector, this cage being arranged to receive an element 30, such as a block, having a through hole 31 for the passage of the securement member 11 of the second profile 3. This element 30 which constitutes an added member can have for example a U shape (FIG. 5) to permit the reception of the end of the securement member 12 of the connector 1 on the first profile 2 between the branches of the U. The dimensions of the element 30 is selected such that the element adjusts perfectly within the recess 27 forming a cage so as to be immobilized axially within it. Similarly, in a manner analogous to that which was described in connection with the first embodiment, the axis D3 of the hole 15 provided in the second profile 3 and the axis D4 of the hole of the member 30 connected on or in said hub 9 are offset so as to obtain, under the influence of penetration of the securement member 11, a gripping effect tending to flatten the distal surface 8 of the profile to be connected against the securement plane 6 of the first profile 2.

Of course, other relative positions of the added member 30 relative to the initial securement 7 can be envisaged, this member 30 being however in all cases immobilized as to axial displacement relative to the initial securement 7.

In short, the process of assembling two profiles by means of a connector according to FIGS. 5 and 6 consists in cutting off the previously oriented connector 1 by means of a cutting member 28, securing the connector on the first profile 2 by means of a first securement member 12, securing the second profile 3 on the connector 1 by means of a second securement member 11, the distal surface 8 of this second profile 3 having first been shaped.

Marking the securement holes 16 and gripping holes 15 to be provided, can take place in a manner analogous to that which was described in connection with the first embodiment. Similarly, the connectors can be precut in a factory or cut out at the work site.

The applications of such a connector are diverse. This connector can particularly be used for the production of frameworks adapted for the production of light constructions but can also serve for the assembly of metallic profiles, of wooden profiles, of plastic profiles, of composite profiles or of mixed profiles for the production of various structures. Several structures are cited hereafter by way of non-limiting example: glass walls, verandas, entry ways, winter gardens, bay windows, curtain walls, fixed frames, skylights, sheds, daylight wells, galleries, covered passages, pyramids, kiosks, swimming pool covers . . .

What is claimed is:

1. A process for connecting solid or hollow profiles along axes of intersection of any angular values (α, β), by a connector constituted by a connector body in the form of a blade (1) having, after bending the blade, a bearing surface provided with a through hole (5) and arranged to be secured on any one of the surfaces of a first profile (2), in which process the connector body is mounted pivotably about a first axis (D1) parallel said through hole (5) so as to fix an orientation of the connector about said axis (D1) corresponding to a first selected angular value (β) of the connector, at least one part of the connector body is mounted pivotably about a second axis (D2) orthogonal to said first axis (D1) so as to fix an orientation of the connector about the axis (D2) corresponding to a second selected angular value (α) of the connector, the previously oriented blade is bent according to said first angular value (β) to provide the bearing surface of the connector body to the first profile (1), the connector is fixed on the first profile (2) by a first securement member (12), there is fixed, on the portion of the connector located beyond the plane parallel to said first axis (D1) and passing through the second pivotal axis (D2) constituting an initial securement (7), directly or by an added member (13, 30), a second profile (3) whose distal portion (8) has first been shaped along a cutting plane corresponding to the manner of angular connection selected, wherein there is used, for bending the end (4) of the connector (1) provided with a through hole (5) for its securement to the first profile (2) a bender having at least two lower (17) and upper (18) gripping jaws forming a vise, the lower jaw (17) comprising, projecting from its gripping surface, a lug (19) arranged to penetrate the through hole (5) of the connector (1), in that initially the connector is oriented by rotation about said lug (19) of the bender and in that the connector (1) is mobilized in an adjustable predetermined angular position at any angle (β), in that in a second instance the connector is bent by means of a pivoting plate (20), disposed adjacent the jaws, in a plane parallel or coincident with the gripping plane of the jaws, this plate (20) forcing, in the course of its pivoting about an axis (D2) parallel to the longitudinal axis of said jaws (17, 18) , the connector (1) to bend by an adjustable predetermined angle (α) about the longitudinal edge (21) of the upper jaw (18), this edge (21) forming the bending axis.

2. A connector for connecting hollow or solid profiles according to the axes of intersection with any angular values (α, β) of the type comprising a bearing surface provided with a through hole (5) and arranged to be secured on any one of the surfaces of a first profile (3) and an initial securement (7) for securing a second profile (3) whose distal portion has been first shaped on a cutting plane corresponding to the manner of angular connection selected, the bearing surface and the initial securement of said connector having been obtained by the practice of the process according to claim 1, the second hollow profile (3) being of the beam type comprising a polyhedral stiffening core, this core being covered, over substantially all its length, with wooden elements surrounding said core and constituting an envelope for said core, wherein the core is constituted essentially of reinforced material and an impregnation binder shaped by pultrusion whilst the wooden elements of the envelope are formed by one or several thicknesses of pieces of wood assembled in butt joined relationship to obtain a length of wooden element at least equal to the length of the core.

3. An assembly or tool kit for practicing the connecting process of two profiles according to claim 1, characterized in that it comprises at least one bender or a cutting tool and two templates, one serving for the production of a securement hole (16) of a first profile, the other serving for the production of a gripping hole (15) of a second profile, these holes (15, 16) permitting the securement of the connector to said profiles.

4. An assembly according to claim 3, characterized in that the bender comprises upper (18) and lower (17) gripping jaws and a plate (20) disposed substantially in prolongation of the bearing surface provided by the lower jaw (17), this plate (20), arranged to pivot about an axis parallel to the longitudinal axis of the jaws, comprising an adjustable abutment (22) coacting with a lug (19) disposed projecting from the gripping surface of the lower jaw (17) so as to immobilize the connector (1) to be bent, mounted rotatably about said lug (19), in a predetermined adjustable angular position relative to the longitudinal axis of said jaws, the connector being then bent by pivoting of the plate within a predetermined adjustable angular range so as to form a bend about the longitudinal edge of the upper jaw, this edge constituting the bending axis (D2).

5. A process for connecting solid or hollow profiles along axes of intersection of any angular values ($\alpha$, $\beta$), by a connector constituted by a connector body in the form of a blade (1) having, after bending the blade, a bearing surface provided with a through hole (5) and arranged to be secured on any one of the surfaces of a first profile (2), in which process the connector body is mounted pivotably about a first axis (D1) parallel said through hole (5) so as to fix an orientation of the connector about said axis (D1) corresponding to a first selected angular value ($\beta$) of the connector, at least one part of the connector body is mounted pivotably about a second axis (D2) orthogonal to said first axis (D1) so as to fix an orientation of the connector about the axis (D2) corresponding to a second selected angular value ($\alpha$) of the connector, the previously oriented blade is bent according to said first angular value ($\beta$) to provide the bearing surface of the connector body to the first profile (1), the connector is fixed on the first profile (2) by a first securement member (12), there is fixed, on the portion of the connector located beyond the plane parallel to said first axis (D1) and passing through the second pivotal axis (D2) constituting an initial securement (7), directly or by an added member (13, 30), a second profile (3) whose distal portion (8) has first been shaped along a cutting plane corresponding to the manner of angular connection selected, wherein there is bent successively the initial securement (7) to obtain an anchoring hub having the form of a cage, and there is enclosed within said cage a block (13), generally of plastic material, having a through hole (14) disposed facing at least one hole (14') of the cage for the passage of the securement member (11) of the second profile (3).

* * * * *